US009658573B2

(12) United States Patent
Saito

(10) Patent No.: US 9,658,573 B2
(45) Date of Patent: May 23, 2017

(54) DEVELOPING UNIT

(71) Applicant: CANON KABUSHIKI KAISHA, Tokyo (JP)

(72) Inventor: Fumiyoshi Saito, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/014,220

(22) Filed: Feb. 3, 2016

(65) Prior Publication Data

US 2016/0154342 A1 Jun. 2, 2016

Related U.S. Application Data

(63) Continuation of application No. 14/634,918, filed on Mar. 2, 2015, now Pat. No. 9,291,945.

(30) Foreign Application Priority Data

Mar. 4, 2014 (JP) ..... 2014-041674

(51) Int. Cl.
*G03G 15/08* (2006.01)

(52) U.S. Cl.
CPC ..... *G03G 15/0891* (2013.01); *G03G 15/0893* (2013.01); *G03G 2215/083* (2013.01)

(58) Field of Classification Search
CPC ..... G03G 15/0822; G03G 15/0839; G03G 15/0877; G03G 15/0891; G03G 15/0893; G03G 2215/0827–2215/0833
See application file for complete search history.

(56) References Cited

U.S. PATENT DOCUMENTS

| | | | |
|---|---|---|---|
| 5,143,017 | A | 9/1992 | Haneda et al. |
| 6,035,168 | A | 3/2000 | Masuda et al. |
| 7,881,638 | B2 | 2/2011 | Noguchi et al. |
| 8,170,451 | B2 | 5/2012 | Murauchi et al. |

(Continued)

FOREIGN PATENT DOCUMENTS

| | | | |
|---|---|---|---|
| JP | 2002-072686 | A | 12/2002 |
| JP | 2010-237329 | A | 10/2010 |

(Continued)

*Primary Examiner* — David Gray
*Assistant Examiner* — Carla Therrien
(74) *Attorney, Agent, or Firm* — Fitzpatrick, Cella, Harper & Scinto

(57) ABSTRACT

A developing unit includes a developer carrier, and first and second chambers to collect and circulate developer. A partition separates the first and second chambers and has first communication portion disposed more downstream in the second chamber and a second communication portion disposed more upstream in the second chamber. A first conveying member is disposed in the first chamber, and a second conveying member is disposed in the second chamber and includes a spiral blade portion, a reverse spiral blade portion helically wound in an opposite direction of the spiral blade portion and disposed downstream of the spiral blade portion, and a discharging portion provided downstream of the reverse spiral blade. An upstream end of the first communication portion is positioned farther than a downstream end of the second communication portion from a center of the developer carrier in a rotational axis direction of the developer carrier.

4 Claims, 9 Drawing Sheets

(56) References Cited

U.S. PATENT DOCUMENTS

| | | | | |
|---|---|---|---|---|
| 8,190,064 | B2 | 5/2012 | Tsutsui et al. | |
| 8,233,826 | B2 | 7/2012 | Saito et al. | |
| 8,233,827 | B2 | 7/2012 | Saito et al. | |
| 8,285,178 | B2 | 10/2012 | Morimoto | |
| 8,320,797 | B2 | 11/2012 | Inomata et al. | |
| 8,750,764 | B2 | 6/2014 | Okuno et al. | |
| 8,874,008 | B2 | 10/2014 | Okuno | |
| 2006/0204283 | A1 | 9/2006 | Yasuda | |
| 2007/0274741 | A1 | 11/2007 | Shiraishi et al. | |
| 2012/0230737 | A1* | 9/2012 | Nakajima | G03G 15/09 399/267 |
| 2013/0149009 | A1 | 6/2013 | Iwata | |
| 2013/0202328 | A1 | 8/2013 | Kimura | |
| 2015/0248078 | A1 | 9/2015 | Mugita et al. | |
| 2015/0248097 | A1 | 9/2015 | Nose et al. | |
| 2015/0323886 | A1* | 11/2015 | Mandai | G03G 15/0891 399/254 |

FOREIGN PATENT DOCUMENTS

| | | | |
|---|---|---|---|
| JP | 2010-256701 | A | 11/2010 |
| JP | 2011-002768 | A | 6/2011 |
| JP | 2012-150316 | A | 9/2012 |

* cited by examiner

DEVELOPING UNIT

This application is a continuation of application Ser. No. 14/634,918, filed Mar. 2, 2015.

BACKGROUND OF THE INVENTION

Field of the Invention

This disclosure relates to a developing unit for stabilizing an amount of a developer inside the unit.

Description of the Related Art

An image forming apparatus which has a two-component development type developing unit mounted thereon is widely used. The developing unit develops an electrostatic image (electrostatic latent image) formed on an image carrier into a toner image by using a two-component developer which includes a non-magnetic toner and a magnetic carrier. One type of developing unit has a configuration in which the two-component developer is stirred and circulated by one pair of conveyance screws which is disposed in a longitudinal direction of a developing container while sandwiching a partition.

In the developing unit, a new non-magnetic toner is supplied in accordance with the consumption of the non-magnetic toner. Meanwhile, since the old magnetic carrier continues to circulate in the developing container, the charging performance of the two-component developer gradually deteriorates. For this reason, a so-called trickle configuration, in which the magnetic carrier in the developing container is also replaced, and the charging performance of the magnetic carrier in the developing container is maintained constantly, by discharging the magnetic carrier in the developing container little by little, and replenishing the carrier by mixing a new carrier into a replenishing developer, is adopted for the developing unit.

As the trickle configuration, in JP-A-2002-72686, a developing unit, which supplies the two-component developer for replenishment in which the magnetic carrier is mixed with the non-magnetic toner at a predetermined ratio, and which replaces the magnetic carrier in the developing container little by little along with an image formation, is suggested.

The developing unit described in JP-A-2002-72686 includes a first conveyance screw, and a second conveyance screw which has a conveyance direction opposite to that of the first conveyance screw. The two-component developer which circulates in the developing container is discharged little by little, passing a discharge opening provided on an abutting surface of the conveyance direction of the second conveyance screw. The second conveyance screw includes a main spiral portion which conveys the two-component developer in a circulating direction and feeds the two-component developer into the discharge opening, and a return screw which has a direction of conveyance opposite to that of a main spiral portion is linked to a downstream side of the main spiral portion. As the first and the second conveyance screws rotate in directions opposite to each other, a flow of the developer in the vicinity of a developer discharging portion passes through an opening which is provided on the return screw side in the partition and the developer is delivered to the first conveyance screw from the second conveyance screw.

Since a blade of the first conveyance screw is inclined, a force which conveys the developer in a cross-sectional radial direction of the first conveyance screw is also applied, in addition to the direction of developer conveyance. Furthermore, the developer which is stripped and dropped from a developing sleeve which rotates in the same direction as that of the first conveyance screw, also receives a force in a different direction by centrifugal force. For this reason, the developer which is conveyed in the cross-sectional radial direction of the first conveyance screw and the developer which is stripped and dropped from the developing sleeve collide with a flow of the developer which passes through the opening and is delivered to the first conveyance screw from the second conveyance screw. Therefore, a flow of the developer is formed in a space which is sandwiched between the partition having the opening and the return screw, the developer flows to the outside of the return screw, and the developer falls into the discharge opening and is delivered to a discharge screw. In this manner, since the flow changes due to the rotational speed of the first conveyance screw and the developing sleeve, the flow of the developer in the space between the partition and the return screw largely fluctuates due to the rotational speed of the first conveyance screw and the developing sleeve.

Here, a developing unit having a configuration in which a discharge amount of the developer is restricted by blocking the flow of the developer in the space between the partition and the return screw which largely fluctuates by the rotational speed of the first conveyance screw by a flange member disposed in the space sandwiched between the partition and the return screw, is suggested in JP-A-2010-256701. The flow of the developer which is blocked by the flange member is pushed back by the return screw. In this case, by the flange member, when the first conveyance screw and the developing sleeve rotate at a high speed, the amount of the two-component developer which is discharged through the discharge opening becomes less, and when the first conveyance screw and the developing sleeve rotate slowly, the flow of the two-component developer which passes through the same space toward the discharge opening slows down, and the discharge amount of the two-component developer is small. For this reason, the discharge amount of the two-component developer depends less on the number of rotations of the first conveyance screw and the developing sleeve.

In recent years, it has been required to reduce toner consumption. When toner consumption is reduced, a frequency of replenishment becomes smaller and the amount of replenishing carriers per unit image decreases. In addition, the amount of the replenishing carriers per unit image decreases when images having an extremely low image ratio continues to be generated, when a driving configuration of the developing unit is shared by a plurality of stations, or when a ratio of the carrier which is mixed in the replenishing developer decreases.

However, in the trickle configuration, it is ideal that the amount of the developer is held within a constant range by increasing and decreasing the discharge amount of the developer in accordance with the amount of the developer and by not discharging the developer when the amount of the developer becomes equal to or less than predetermined amount of the developer. However, in the configuration described in JP-A-2010-256701, the flow of the developer in the space between the partition and the return screw decreases by providing the flange member, but when considering component tolerance, a gap between the flange member and the return screw cannot be eliminated. For this reason, even when the amount of developer becomes smaller, the developer is discharged from the gap between the partition and the return screw little by little. Therefore, when the amount of the replenishing carrier per unit image is small, there is a concern of causing a so-called coating defect in which the amount of the developer in the developing container decreases, and the developing sleeve cannot be coated with the developer.

SUMMARY OF THE INVENTION

According to an aspect of this disclosure, there is provided a developing unit including: a developer carrier configured to hold a developer including a toner and a carrier on a developer carrying area and convey the developer; a first chamber configured to collect the developer from the developer carrier; a second chamber configured to include a first communication portion and a second communication portion which communicate with the first chamber and to circulate the developer between the first chamber and the second chamber via the first communication portion and the second communication portion; a first conveying member configured to be disposed in the first chamber and to convey the developer in the first chamber; a second conveying member configured to be disposed in the second chamber and to include a spiral blade portion so as to convey the developer in the second chamber in a direction opposite to a developer conveyance direction of the first conveying member; a third conveying member configured to be disposed downstream of the second conveying member in a developer conveyance direction of the second conveying member in the second chamber and to include a spiral blade helically formed with being wound in an opposite direction of the spiral blade portion and provided to be integrated coaxially with the second conveying member; and a discharging portion configured to be provided downstream of the third conveying member in the developer conveyance direction of the second conveying member and to discharge a surplus developer. The developer carrying area of the developer carrier extends from a position located downstream in the developer conveyance direction of the first conveying member further than the first communication portion up to a position facing the second communication portion.

Further features of the present invention will become apparent from the following description of exemplary embodiments (with reference to the attached drawings).

DESCRIPTION OF THE EMBODIMENTS

Hereinafter, embodiments according to this disclosure will be described in detail with reference to the drawings. In addition, the embodiments to be described below are preferred embodiments of this disclosure, and are limited to be technically preferable. However, unless there is any particular mention which limits this disclosure in the description below, the range of this disclosure is not limited to these embodiments.

As long as a flow of a two-component developer which passes through a space sandwiched between a partition and a conveying member toward a discharge opening is suppressed, the embodiments can be employed even in other aspects in which a part of the configuration or the entire configuration thereof is switched with the alternative configuration thereof. Therefore, this disclosure can be realized similarly in various aspects of the image forming apparatuses which commonly have a developing unit. This disclosure can be employed regardless of the type, such as an intermediate transfer type, a recording medium (sheet) conveying body type, a tandem type, a one-drum type, a full-color type, and a monochrome type.

<First Embodiment>

In the embodiment, main portions which are related to forming/transferring of a toner image will be mainly described. However, this disclosure can be employed in various uses, such as a printer, various types of printing machines, a copying machine, a facsimile, or multi-purpose peripherals, by adding necessary units, apparatuses, and casing structures.

[Image Forming Apparatus]

Figure 1:
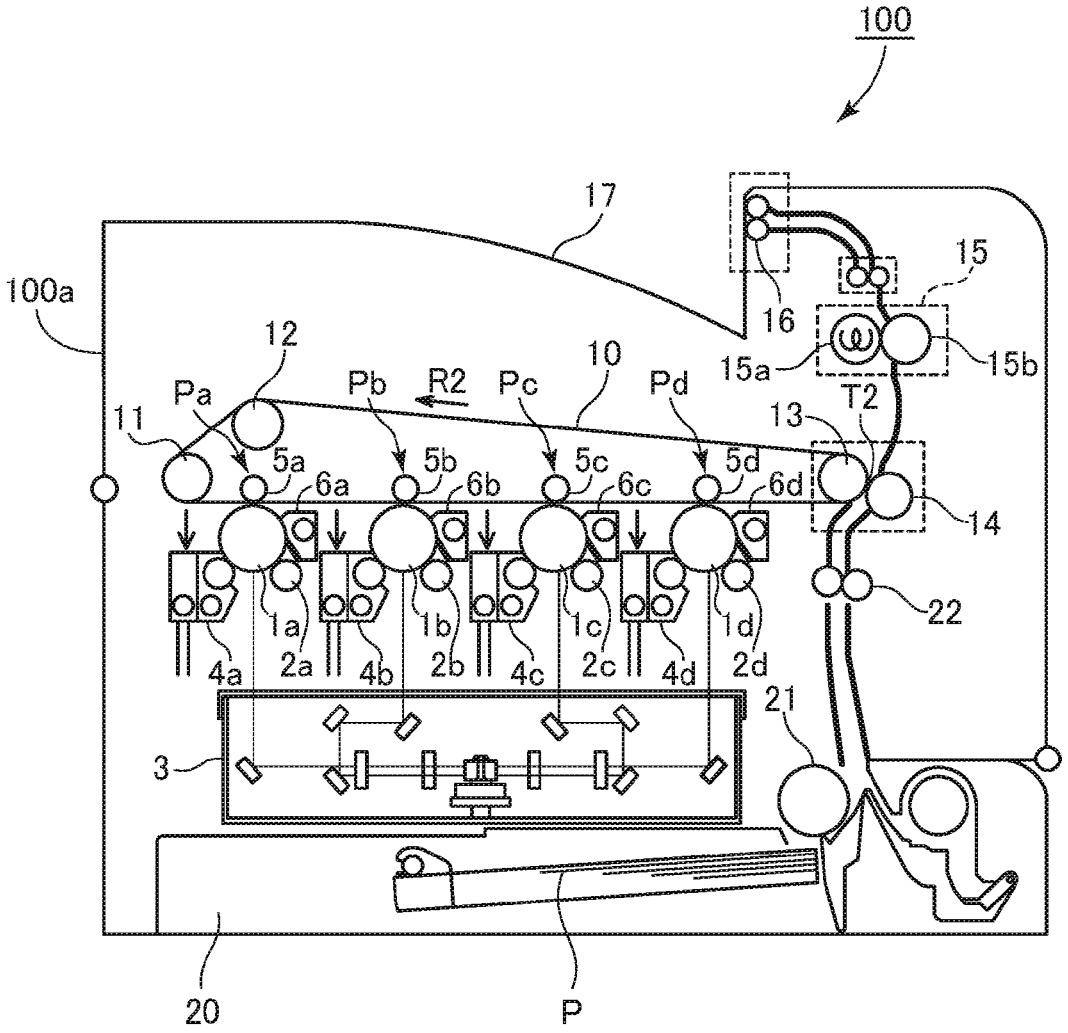
FIG. 1 is a schematic section view of an image forming apparatus in an embodiment of this disclosure.

FIG. 1 is a view illustrating a configuration of an image forming apparatus 100 in the embodiment. As illustrated in FIG. 1, the image forming apparatus 100 includes an image forming apparatus body (apparatus main body) 100*a*. The image forming apparatus 100 is a tandem-type intermediate transfer type full-color printer, in which image forming portions Pa, Pb, Pc, and Pd are aligned along a downward surface of an intermediate transfer belt 10, and which is operated, for example, at a process speed of 300 mm/sec.

In the image forming portion Pa, a yellow toner image is formed in a photoconductive drum 1*a*, and is primarily transferred to the intermediate transfer belt 10. In the image forming portion Pb, a magenta toner image is formed in a photoconductive drum 1*b*, is overlapped with the yellow toner image of the intermediate transfer belt 10, and is primarily transferred. In the image forming portions Pc and Pd, a cyan toner image and a black toner image are respectively formed in photoconductive drums 1*c* and 1*d*, and similarly, are overlapped in order, and are primarily transferred to the intermediate transfer belt 10.

The toner images of four colors which are primarily transferred to the intermediate transfer belt 10 are conveyed to a secondary transfer portion T2, and are secondarily transferred to a recording medium P all together. The recording medium P to which the toner images of four colors are secondarily transferred passes through a discharging roller 16 and is discharged to an upper tray 17 after heating pressure is received by a fixing unit 15 and the toner images are fixed to a front surface.

A separating roller 21 separates the recording medium P which is drawn out from a recording medium cassette 20 one by one and sends out the recording medium P to a registration roller pair 22. The registration roller pair 22 accepts the recording medium P, makes the recording medium P stand by in a stopped state, and sends out the recording medium P to the secondary transfer portion T2 by matching the timing with the toner image of the intermediate transfer belt 10.

The fixing unit 15 brings the pressing roller 15*b* into pressure-contact with a fixing roller 15*a* having a heater, and forms a heating nip. The recording medium P is heated and pressed in a process of being nipped and conveyed by the heating nip, the toner image is melted, and a full-color image is fixed to the front surface.

The image forming portions Pa, Pb, Pc, and Pd are configured substantially the same as each other, except that the colors of the toners which are used in developing units 4 (4*a*, 4*b*, 4*c*, 4*d*) are different from each other to be yellow, magenta, cyan, and black. In addition, hereinafter, the image forming portion Pa will be described, and other image forming portions Pb, Pc, and Pd are described by replacing a at the end of reference numerals in the description with b, c, and d.

The image forming portion Pa includes a charging roller 2*a*, an exposing unit 3, the developing unit 4*a*, a primary transfer roller 5*a*, and a cleaning unit 6*a*, which are disposed to surround the photoconductive drum 1*a*. The photoconductive drum 1*a* forms a photoconductive layer having a negative charging polarity on an outer peripheral surface of an aluminum cylinder, and rotates at plural steps of switchable process speeds. The charging roller 2*a* charges the front surface of the photoconductive drum 1*a* to a uniform negative polarity by applying an oscillation voltage which is made by superposing an AC voltage on a DC voltage, and by performing driven rotation to the photoconductive drum 1*a*.

The exposing unit 3 scans a laser beam which ON-OFF modulates scanning line image data which expands a yellow separation color image with a rotary mirror, and writes an electrostatic latent image onto the front surface of the charged photoconductive drum 1*a*.

The developing unit 4*a* carries the two-component developer which is stirred and charged by a first conveyance screw 45 and a second conveyance screw 46 which will be described later, by a developing sleeve 43 (refer to FIG. 2). As the oscillation voltage which is made by superposing the AC voltage on the DC voltage is applied to the developing sleeve 43, a non-magnetic toner which is charged to have a negative polarity is transferred to the electrostatic latent image (exposing unit) which has a relatively positive polarity with respect to the developing sleeve 43, and an electrostatic image is reverse-developed. A configuration of the developing unit 4*a* will be described in detail later.

The primary transfer roller 5*a* presses an inner side surface of the intermediate transfer belt 10, and forms a primary transfer portion between the photoconductive drum 1*a* and the intermediate transfer belt 10. As the DC voltage having a positive polarity is applied to the primary transfer roller 5*a*, a toner image having a negative polarity which is carried by the photoconductive drum 1*a* is primarily transferred to the intermediate transfer belt 10 which passes through the primary transfer portion.

The intermediate transfer belt 10 is supported to cross over a tension roller 12, a drive roller 11, and an extension roller 13, and rotates in an arrow R2 direction by the drive of the drive roller 11. A secondary transfer roller 14 forms a secondary transfer portion T2 as an inner side surface abuts against the extended intermediate transfer belt 10 by the extension roller 13 which is connected to a ground potential. As the DC voltage having a positive polarity is applied to the secondary transfer roller 14, the toner image which is carried by the intermediate transfer belt 10 is secondarily transferred to the recording medium P.

[Developing Unit]

Figure 3:
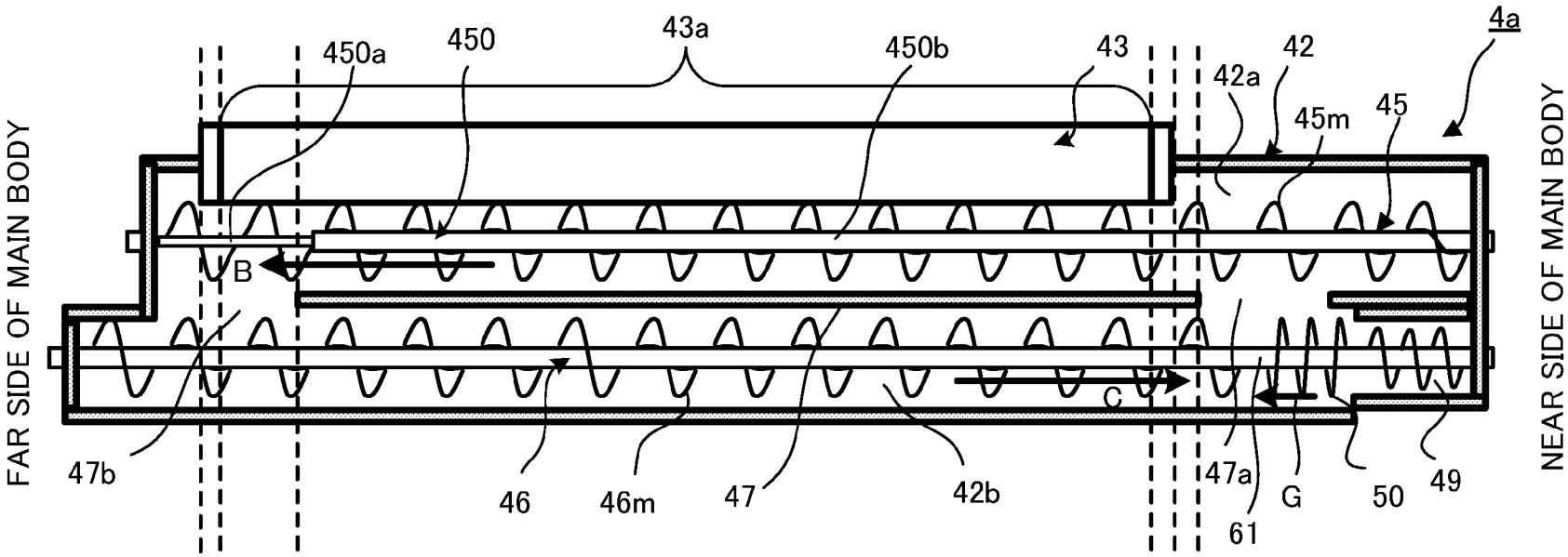
FIG. 3 is a plan view illustrating a state where the developing unit is cross-sectioned along an axial direction.
Figure 4A:
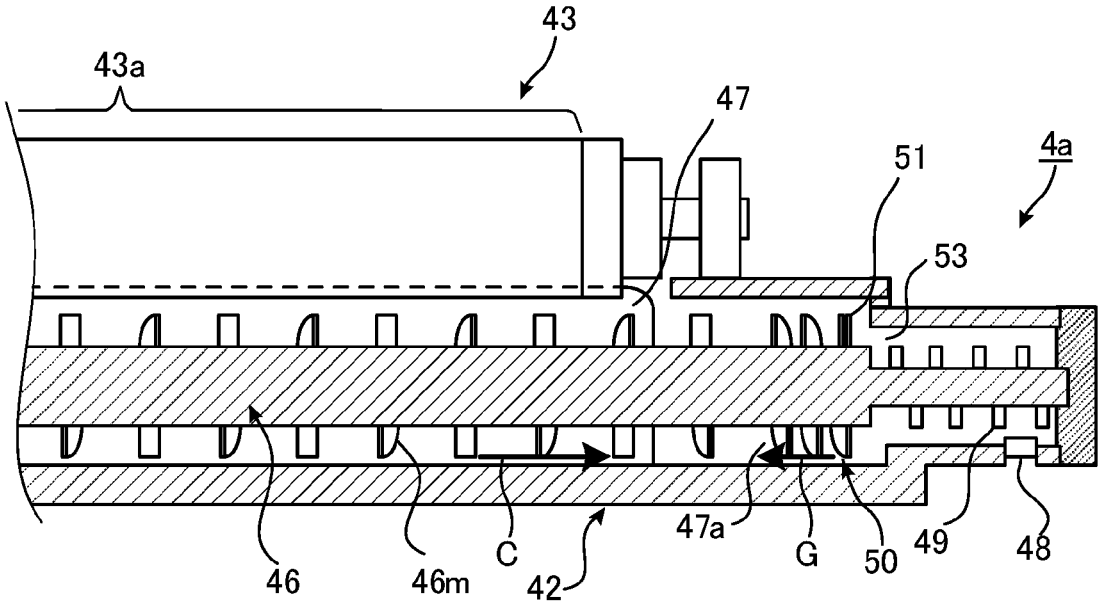
FIG. 4A is a section view illustrating the vicinity of a developer discharge port of the developing unit.
Figure 4B:
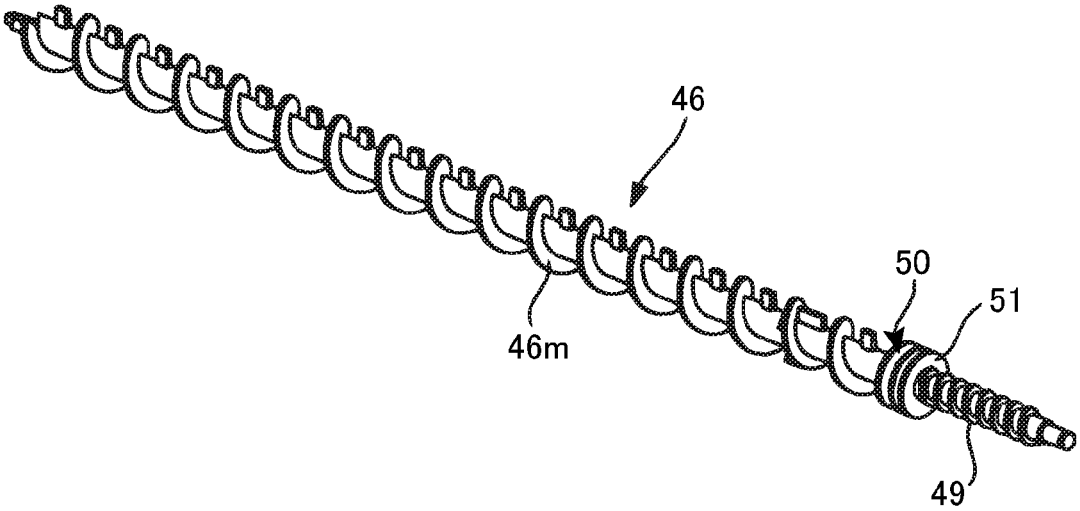
FIG. 4B is a perspective view illustrating a second conveyance screw.
Figure 5A:
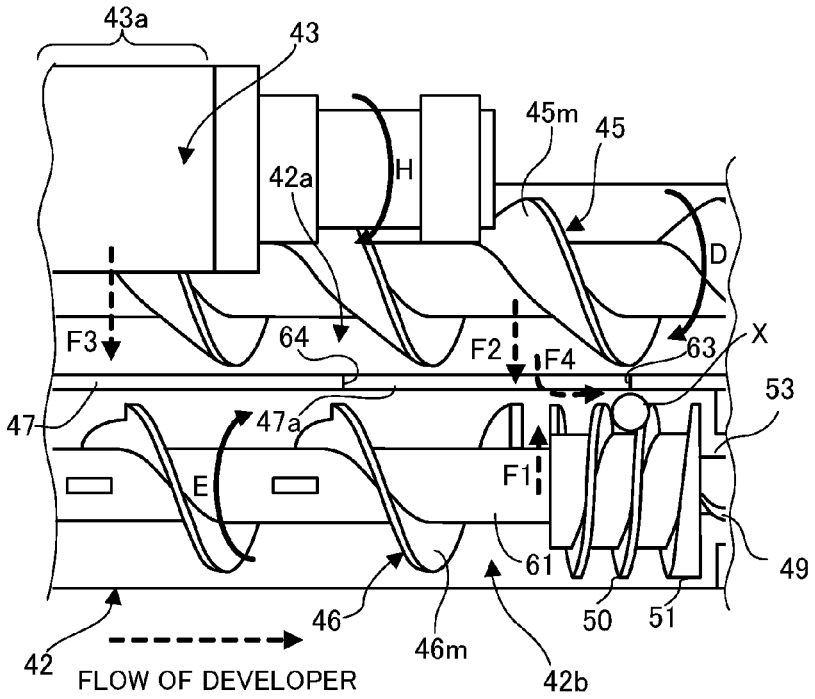
FIG. 5A is a view illustrating a flow of the developer in the vicinity of a developer discharging portion according to a first embodiment.

Next, the developing unit 4*a* according to the embodiment will be described with reference to FIGS. 2 to 5A. However, it is needless to say that other developing units 4*b* to 4*d* also include a similar configuration and have similar functions to those of the developing unit 4*a*. In addition, FIG. 2 is a section view illustrating a state where the developing unit 4*a* is viewed from a near side of a sheet surface of the image forming apparatus 100 (refer to FIG. 1). FIG. 3 is a plan view of the developing unit 4*a*. FIG. 4A is a section view which enlarges the vicinity of a developer discharge port. FIG. 4B is a perspective view illustrating the second conveyance screw 46 provided with a return screw (third conveying member) 50. FIG. 5A is a view illustrating a flow of the developer in the vicinity of the developer discharging portion according to the embodiment.

Figure 2:
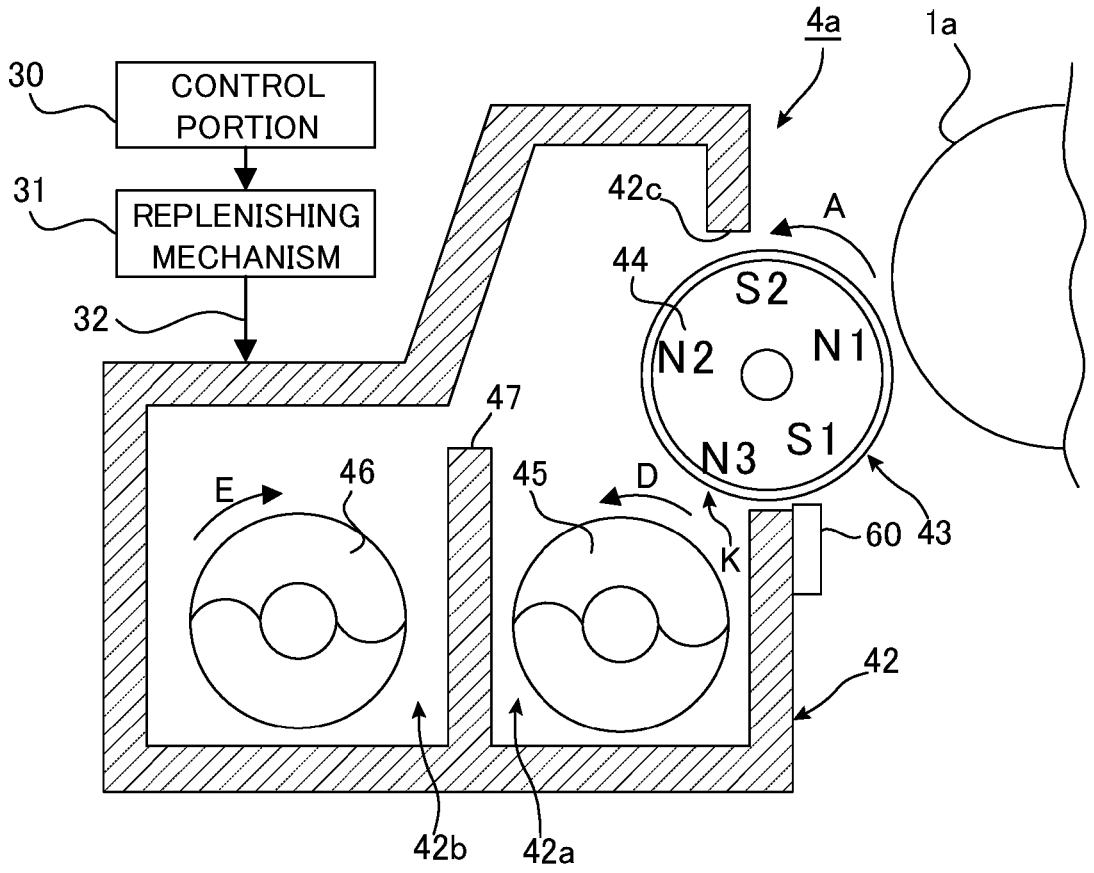
FIG. 2 is a section view illustrating a state where a developing unit is cross-sectioned in a direction orthogonal to an axis.

The near side of the sheet surface in FIG. 2 corresponds to a front surface side on which the two-component developer is discharged. As illustrated in FIG. 2, the developing unit 4*a* is provided with a developer container 42 which includes a first storage chamber (first chamber) 42*a* and a second storage chamber (second chamber) 42*b*. The developing unit 4*a* includes an opening 42*c* of the developing container 42 which is formed to open a part of the developing area which opposes the photoconductive drum 1*a*, and the developing sleeve 43 as the developer carrier which is supported to be rotatable so that a part thereof is exposed to the photoconductive drum 1*a* side from the opening 42*c*.

The first storage chamber 42*a* collects the developer from the developing sleeve 43 as the developer carrier. The second storage chamber 42*b* includes openings 47*a* and 47*b* which communicate with the first storage chamber 42*a*, and circulates the developer (two-component developer) between the first storage chamber 42*a* and the second storage chamber 42*b* via the openings 47*a* and 47*b*. The opening 47*a* is configured of a first communication portion according to this disclosure.

In the developer container 42, the two-component developer (not illustrated) which is made of the non-magnetic toner and a magnetic carrier is stored. In the embodiment, a mixture ratio of the non-magnetic toner and the magnetic carrier is approximately set to be 1:9 in terms of the weight ratio. Here, the mixture rate of the non-magnetic toner and the magnetic carrier is appropriately adjusted according to a charging amount of the toner, a particle diameter of the carrier, or the configuration of the image forming apparatus 100, but is not necessarily limited to this value.

As the first and the second storage chambers 42*a* and 42*b* are disposed to be aligned in a horizontal direction (right-and-left direction in FIG. 2), and the developing sleeve 43 is disposed on an upper side of the first storage chamber 42*a*, the developer which is peeled from the developing sleeve 43 is efficiently collected in the first storage chamber 42*a* (in the first chamber). Inside the developing sleeve 43, a magnet 44 which is provided with a plurality of fixed magnetic poles is disposed in a non-rotating state.

The developing sleeve 43 is formed of a non-magnetic material, and rotates the two-component developer in the developer container 42 in an arrow A direction in a state of being carried by a magnetic force of the magnet 44 during a developing operation. The developing sleeve 43 retains the carried two-component developer in a layered shape and conveys the two-component developer to the developing area by a regulating member 60 which is attached to a lower side of the opening 42*c* on an outer wall of the developer container 42.

The developing sleeve 43 supplies only the non-magnetic toner in the two-component developer to the photoconductive drum 1*a* in the developing area, and develops the electrostatic image (electrostatic latent image) which is formed on the photoconductive drum 1*a*. In the developing sleeve 43, after developing the electrostatic image, the two-component developer on the developing sleeve is peeled by the rotation of the developing sleeve 43 and a repulsive pole (N2) of the magnet 44, and is collected in the first storage chamber 42*a* of the developer container 42.

In this manner, the developing sleeve 43 is formed as a cylindrical carrier which is disposed on the upper side of the first storage chamber 42*a*, and has a plurality of permanent magnets S1, N1, S2, N2, and N3 of an S pole (first magnetic polarity) and an N pole (second magnetic polarity) in a circumferential direction thereof. The developing sleeve 43 rotates in a direction in which the developer is peeled at a position (position which corresponds to the N2) above a drawn-up part (K) after drawing up and conveying the developer upward at the drawn-up part which is illustrated by an arrow K in FIG. 2 and which corresponds to a permanent magnet N3 positioned below among a plurality of permanent magnets. According to this configuration, while the two-component developer which is carried by a coating area 43*a* (refer to FIG. 3) is in a layered shape in an appropriate state by the regulating member 60, it is possible to retain the developer in the developing sleeve 43 and to smoothly convey the developer to the developing area.

As illustrated in FIG. 2, the developing unit 4*a* is replenished to an upstream side (far side of the main body) of the second conveyance screw 46 of the developer container 42 by a replenishing mechanism 31 which is operated by a control of a control portion 30 (refer to FIG. 3). A two-component developer for replenishment to the developing unit 4*a* is replenished by the rotation of a replenishing screw 32 from a hopper (not illustrated) of the replenishing mechanism 31, and inflows from a replenish port (not illustrated) on the upper side of the developer container 42.

The control portion 30 includes a ROM, a RAM, and a CPU which are not illustrated, controls ON/OFF of the rotation and a rotational speed of the replenishing screw 32, and replenishes the two-component developer for replenishment so that the toner density of the two-component developer is held to be constant inside the developer container 42.

In addition, as illustrated in FIGS. 2 and 3, the inside of the developer container 42 is partitioned by a partition 47 which extends in a longitudinal direction and in which the above-described openings 47*a* and 47*b* (the width of both openings is approximately 25 mm) are formed on both side ends to deliver the developer (two-component developer). Accordingly, the inside of the developer container 42 is divided by the first storage chamber 42*a* and the second storage chamber 42*b* while sandwiching the partition 47.

In the first storage chamber 42*a*, the first conveyance screw 45 as a first conveying member is stored to be rotatably supported, and in the second storage chamber 42*b*, the second conveyance screw 46 as a second conveying member is stored to be rotatably supported. The first conveyance screw 45 in the first storage chamber 42*a* conveys the developer in the first storage chamber 42*a*. Then, the second conveyance screw 46 in the second storage chamber 42*b* (in the second chamber) conveys the developer in the second storage chamber in a direction (arrow C direction) opposite to a developer conveyance direction (arrow B direction in FIG. 3) by the first conveyance screw 45.

In this manner, the developer conveyance directions of the first and the second conveyance screws 45 and 46 are set to be opposite to each other, the first conveyance screw 45 conveys the developer in the arrow B direction while stirring the developer, and the second conveyance screw 46 conveys the developer in the arrow C direction while stirring the developer. Therefore, as the two-component developer passes through the openings 47*a* and 47*b* on both side ends of the partition 47 in the longitudinal direction and is smoothly delivered by the first conveyance screw 45 and the second conveyance screw 46, the two-component developer can smoothly circulate inside the developer container 42.

As illustrated in FIGS. 3, 4A, and 4B, a return screw 50 as a third conveying member that conveys the developer to push back the developer to the inside of a circulation path from the outside of the circulation path of the developer, is connected to be integrated coaxially with the downstream side of the second conveyance screw 46 in the direction of developer conveyance (arrow C direction). The second conveyance screw 46 has a main spiral portion 46*m* formed in a spiral shape. The return screw 50 has a spiral blade helically formed with being wound in an opposite direction of the main spiral portion 46*m*. In other words, the return screw 50 is linked to the main spiral portion 46*m* of the second conveyance screw 46 so that the flow of the developer toward a discharging portion 53 is biased in the opposite direction. The main spiral portion 46*m* conveys the two-component developer toward the discharging portion 53 in the circulation path.

In this manner, the return screw 50 is disposed downstream of the second conveyance screw 46 of the second storage chamber 42*b* in the direction of developer conveyance (arrow C direction), and the flow of the developer which is conveyed by the second conveyance screw 46 is biased in the opposite direction (arrow G direction). Accordingly, the developer in the second storage chamber 42*b* can pass the opening 47*a* and can be smoothly conveyed to the first storage chamber 42*a*. In addition, since the return screw 50 is configured to be integrated coaxially with the second conveyance screw 46, it is possible to simplify an assembling process by reducing the number of components.

As illustrated in FIGS. 3 and 5A, at a position facing a joint 61 between the main spiral portion 46*m* and the return screw 50 of the second conveyance screw 46, the opening 47*a* which delivers the developer to the first conveyance screw 45 from the second conveyance screw 46 is provided. The coating area 43*a* of the developing sleeve 43 extends from a position located downstream in the developer conveyance direction (arrow B direction) of the first conveyance screw 45 further than the opening (first communication portion) 47*a* up to a position facing the opening (second communication portion) 47*b*.

As illustrated in FIG. 4A, upstream of the developer conveyance direction (arrow G direction) by the return screw 50, the discharging portion 53 which discharges a part of the circulating two-component developer to the outside of the developer container 42 is provided. In other words, the discharging portion 53 is provided downstream (right side in FIG. 4A) of the return screw 50 in the developer conveyance direction (arrow C direction) by the second conveyance screw 46 to discharge a surplus developer.

Most of the two-component developer which is conveyed toward the discharging portion 53 by the main spiral portion 46*m* of the second conveyance screw 46 is pushed back by the return screw 50 and to avoid being discharged from the discharging portion 53. Then, the two-component developer which is not pushed back to the return screw 50 passes through the discharging portion 53, and is discharged from a developer discharge port 48, which will be described later, via the circulation path of the developer container 42.

A length, a diameter, and a pitch of the return screw 50 are appropriately changed according to a configuration or a discharging condition of the developing unit 4*a*, an amount of the two-component developer in the developer container 42, and a target discharge amount. For example, when the length of the return screw 50 is extremely long, the discharge of the two-component developer is suppressed more than necessary, and there is a possibility that the charging performance of the two-component developer in the developer container 42 deteriorates. Conversely, when the length of the return screw 50 is extremely short, the two-component developer is discharged more than necessary, the amount of the two-component developer in the developer container 42 is not sufficient, and there is a possibility of causing a trouble in developing.

As illustrated in FIGS. 4A and 4B, at an uppermost stream in a conveyance direction of the return screw 50, a disc-shaped brim portion 51 is provided to cover and hide the discharging portion 53. In the brim portion 51, a disc-shaped part which opposes the discharging portion 53 is linked to the return screw 50 to be overlapped with the discharging portion 53 of the return screw 50 in the longitudinal direction.

The brim portion 51 reduces a difference in inertial force of the two-component developer which is conveyed toward the discharging portion 53, by a difference in conveying performance between the main spiral portion 46*m* of the second conveyance screw 46 and the return screw 50. The brim portion 51 reduces the amount of the two-component developer which passes through a valley portion at a tip of a conveying blade of the return screw 50 and falls into the discharging portion 53, and stabilizes the discharge amount of the two-component developer.

In other words, a configuration, in which the brim portion 51 covers the tip which opposes the discharging portion 53 of the return screw 50 and does not expose the valley portion of the tip of the conveying blade to the discharging portion 53 side, is employed. For this reason, by employing the return screw 50 provided with the brim portion 51, it is possible to ensure a necessary discharge amount of the two-component developer even when the rotational speed of the second conveyance screw 46 is switched to a low speed. In addition, even when the rotational speed of the second conveyance screw 46 is switched to a high speed, it is possible not to radically increase the discharge amount of the two-component developer.

Furthermore, a discharge screw 49 is linked to the upstream side of the return screw 50 in a developer conveyance direction (arrow G direction) of the return screw to penetrate the center of the discharging portion 53 and to be coaxial with the return screw 50. The discharge screw 49 carries out the two-component developer which climbs over the brim portion 51 and drops through the discharging portion 53, conveys the two-component developer to the developer discharge port 48, and discharges the two-component developer to the outside of the developing unit 4*a*.

[Replenishment Control of Two-component Developer for Replenishment]

Next, a replenishment control of the two-component developer for replenishment in the embodiment will be described. As illustrated in FIG. 2, the non-magnetic toner which is consumed when forming the image is replenished to the upstream side (far side of the main body) of the second conveyance screw 46 of the developer container 42 by the replenishing mechanism 31 which is operated by the control of the control portion 30, as the two-component developer for replenishment including a new magnetic carrier at a constant ratio. The two-component developer for replenishment to the developing unit 4*a* is replenished by the rotation of the replenishing screw 32 from the hopper of the replenishing mechanism 31, and inflows from the replenish port (not illustrated) on the developer container 42 side.

In the two-component developer for replenishment, among the non-magnetic toners for replenishment, the two-component developer including the magnetic carrier at a constant ratio (approximately 10% in terms of weight ratio) is used, but the mixture ratio of the magnetic carrier is not limited thereto. The replenished amount of the two-component developer for replenishment is substantially determined by the number of rotations of the replenishing screw 32 of the replenishing mechanism 31.

The amount of the two-component developer in the developer container 42 gradually increases as the image is formed. The non-magnetic toner is consumed by forming the image, but since the magnetic carrier is not consumed, it remains inside the developer container 42, and keeps circulating, and thus the amount of the two-component developer in the developer container 42 increases.

When the amount of the two-component developer increases, the developer climbs over the return screw 50 and the brim portion 51 illustrated in FIG. 4A, falls into the discharging portion 53, is delivered to the discharge screw 49, and is conveyed toward the developer discharge port 48. The conveyed and collected developer is discharged from the developer discharge port 48, merges with a developer collection pipe which is not illustrated, passes through the developer collection pipe, and is gathered, collected, and saved in the collecting container which is not illustrated.

In this manner, while the consumed non-magnetic toner is replenished by the two-component developer for replenishment, in parallel, the two-component developer inside the developer container 42 which has excessive magnetic carrier is discharged little by little. As the two-component developer is automatically and gradually switched to hold the amount of the two-component developer to be constant in the developer container 42, a function of automatically discharging the developer is realized.

Figure 9A:
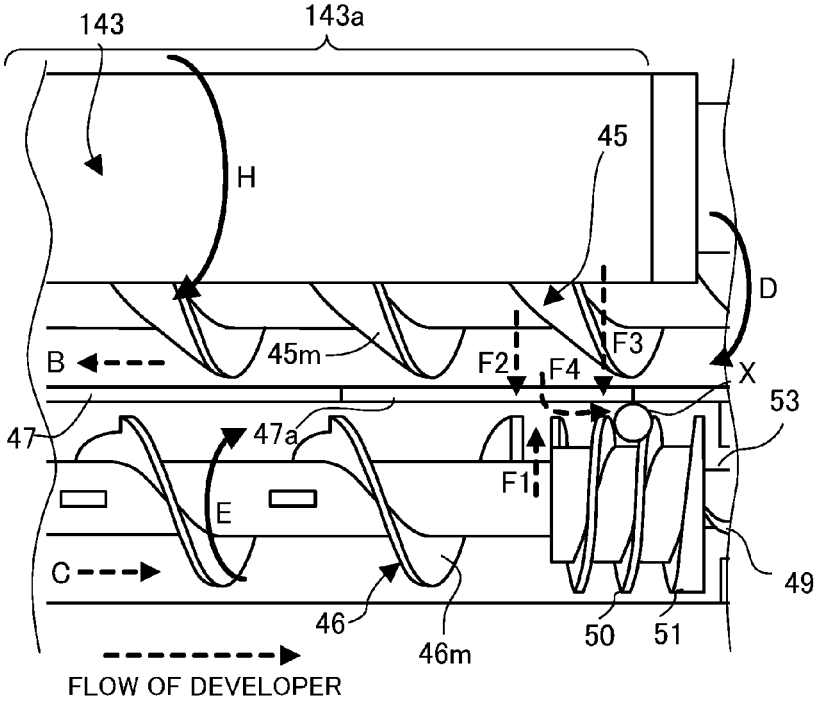
FIG. 9A is a view illustrating a flow of the developer in the vicinity of a developer discharging portion in Comparative Example 1.

However, as described below with reference to FIG. 9A, in the flow of the developer in the vicinity of the developer discharging portion, a flow (arrow F1) of the developer when the developer is delivered to the first conveyance screw 45 from the second conveyance screw 46, is present. Furthermore, a flow (arrow F2) of the developer to convey the two-component developer in a cross-sectional radial direction of the first conveyance screw 45, and a flow (arrow F3) of the developer which is stripped and dropped from the developing sleeve 43 which rotates in the same direction as that of the first conveyance screw 45, is present. As a combined flow of theses flows, a flow (arrow F4) of the developer in a space sandwiched between the partition 47 and the return screw 50 is generated.

In addition, even when the amount of the developer is small, the flow (arrow F4) of the developer in the space sandwiched between the partition 47 and the return screw 50 is present, and the amount of the developer gradually decreases. For example, when a developer drive is the same drive as that of the developing unit of other image forming portions, even if the toner is not consumed, there is a case where the developing unit is driven and does not perform a replenishment operation. In this case, the amount of the developer in the developing unit gradually decreases.

Figure 8:
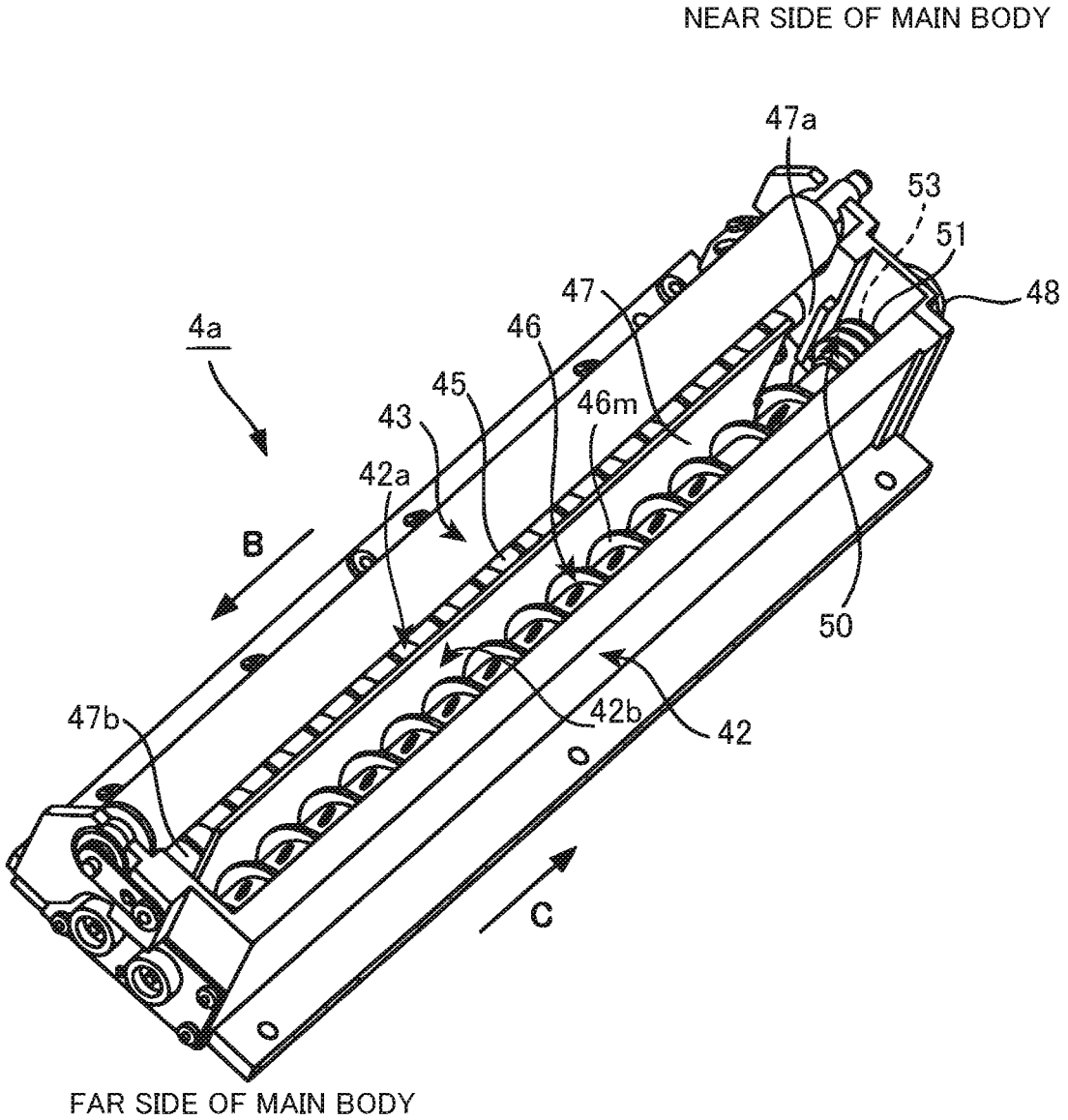
FIG. 8 is a perspective view of the developing unit for illustrating a configuration in the Comparative Examples.
Figure 9B:
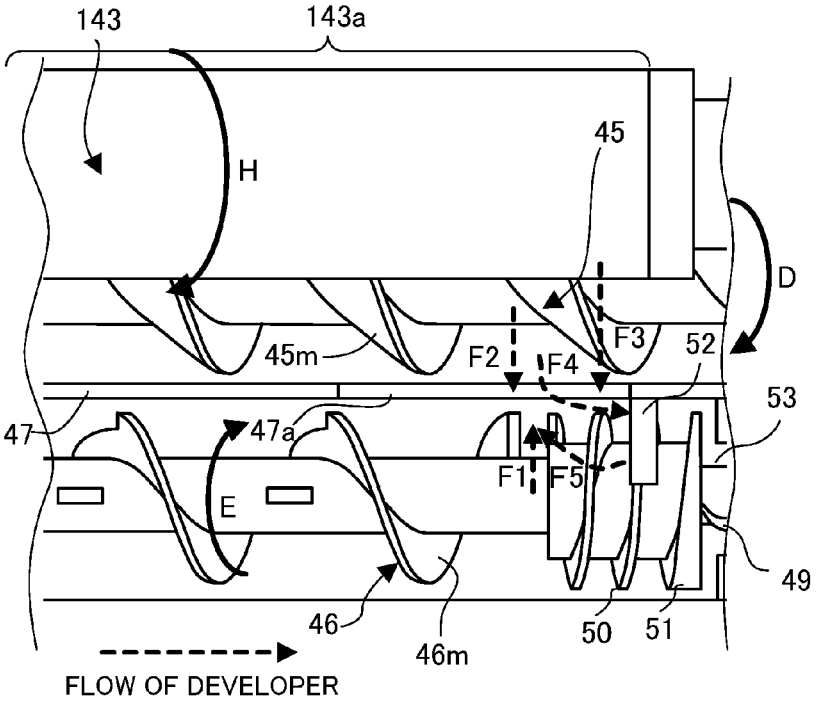
FIG. 9B is a view illustrating a flow of the developer in the vicinity of the developer discharging portion in Comparative Example 2.

Here, Comparative Example 1 which corresponds to the above-described JP-A-2002-72686 and Comparative Example 2 which corresponds to the above-described JP-A-2010-256701 will be described with reference to FIGS. 8 and 9. In addition, FIG. 8 is a perspective view of the developing unit for illustrating a configuration in the Comparative Examples. FIG. 9A is a view illustrating a flow of the developer in the vicinity of the developer discharging portion in Comparative Example 1. FIG. 9B is a view illustrating a flow of the developer in the vicinity of the developer discharging portion in Comparative Example 2. In addition, in Comparative Example 1 and Comparative Example 2, the same or corresponding configuration elements as those in the first embodiment are given the same reference numerals, and the description thereof will be appropriately omitted.

First, a developing unit in Comparative Example 1 will be described with reference to FIG. 8. The two-component developer, which passes through the discharging portion 53 disposed on the abutting surface of the second conveyance screw 46 in the direction of conveyance, and circulates inside the developer container 42, is discharged little by little. The return screw 50 which conveys the two-component developer in the conveyance direction opposite to that of the main spiral portion, is linked to the downstream side of the main spiral portion which conveys the two-component developer in the circulating direction (arrow C direction) and feeds the two-component developer into the discharging portion 53, in the second conveyance screw 46. The return screw 50 pushes back most of the two-component developer which is conveyed to the main spiral portion and moves toward the discharging portion 53, and prevents the two-component developer which is discharged through the discharging portion 53 from being excessive.

Next, with reference to FIG. 9A, a flow of the developer in the vicinity of the developer discharging portion in Comparative Example 1 will be described. In other words, the first and the second conveyance screws 45 and 46 respectively rotate in an arrow D direction and in an arrow E direction, and through the opening 47*a* near the return screw 50, the two-component developer flows and is delivered in the arrow F1 direction to the first conveyance screw 45 from the second conveyance screw 46. In addition, in the configurations of Comparative Example 1 and Comparative Example 2, a coating area 143*a* for holding the developer by a developing sleeve 143 is provided to oppose the opening 47*a*.

In the first conveyance screw 45, since the blade of the screw is inclined, a force which conveys the two-component developer even in the cross-sectional radial direction of the first conveyance screw 45 is applied (arrow F2 direction), in addition to the conveyance direction of the two-component developer (arrow B direction). Furthermore, the developer which is stripped and dropped from the developing sleeve 43 which rotates in the same direction as that of the first conveyance screw 45 receives a force even in the arrow F3 direction by centrifugal force.

For this reason, the developer which is conveyed in the cross-sectional radial direction of the first conveyance screw 45 and the developer which is stripped and dropped from the developing sleeve 43, collide with the flow of the two-component developer which passes through the opening 47*a* and is delivered to the first conveyance screw 45 from the second conveyance screw 46. Then, in the space which is sandwiched between the partition 47 and the return screw 50, as the flow of the two-component developer is formed as illustrated by the arrow F4, the developer flows to the outside of the return screw 50, and the developer climbs over the brim portion 51, the developer falls into the discharging portion 53 and reaches the discharge screw 49. In this manner, since the flow in the arrow F2 direction and in the arrow F3 direction changes by the rotational speed of the first conveyance screw 45 and the developing sleeve 43, the flow of the developer in the arrow F4 direction in the space which is sandwiched between the partition 47 and the return screw 50 largely fluctuates by the rotational speed of the first conveyance screw 45 and the developing sleeve 43.

Here, in Comparative Example 2, as illustrated in FIG. 9B, the flow of the developer in the arrow F4 direction in the space which is sandwiched between the partition 47 and the return screw 50, which largely fluctuates by the rotational speed of the first conveyance screw 45, is blocked by a restriction member 52 which is disposed in this space. The flow of the developer which is blocked by the restriction member 52 is pushed back by the return screw 50 and is illustrated by an arrow F5.

In other words, by the restriction member 52, when the first conveyance screw and the developing sleeve rotate at a high speed, the amount of the two-component developer which passes through the discharging portion 53 and is discharged decreases, and when the first conveyance screw and the developing sleeve rotate slowly, the flow of the two-component developer which passes through the same space toward the discharging portion 53 slows down, and the discharge amount of the two-component developer is small. For this reason, the dependency of the discharge amount of the developer of the two-component developer on the number of rotations decreases.

In recent years, the demand for reducing a toner consumption amount has been increasing. This is because, when the toner consumption amount decreases, a frequency of replenishment becomes less, and an amount of the replenishing carrier per unit image decreases. The amount of the replenishing carrier per unit image decreases when the images having an extremely low image ratio continue to be generated, when a driving configuration of the developing unit is shared by a plurality of stations, or when a ratio of the carrier which is mixed in the replenishing developer decreases.

In a trickle configuration, it is ideal that the amount of the developer is held within a constant range by increasing and decreasing the discharge amount of the developer in accordance with the amount of the developer and by not discharging the developer when the amount of the developer becomes equal to or less than predetermined amount of the developer. However, in the configuration of Comparative Example 2, the flow of the developer in the space which is sandwiched between the partition 47 and the return screw 50 cannot be fundamentally solved. In other words, in Comparative Example 2, the flow of the developer in the space which is sandwiched between the partition 47 and the return screw 50 decreases by providing the restriction member 52, but when considering component tolerance, a gap between the restriction member 52 and the return screw 50 cannot be zero. For this reason, even when the amount of developer becomes smaller, the developer is discharged from the space (gap) between the partition 47 and the return screw 50 little by little.

Therefore, even in any of Comparative Examples 1 and 2, when the amount of the replenishing carrier per unit image is small, there is a concern of causing a so-called coating defect in which the amount of the developer in the developing container decreases, and the developing sleeve 43 cannot be sufficiently coated with the developer.

Here, in the embodiment, a configuration, in which the flow (arrow F4) of the developer in the space which is sandwiched between the partition 47 and the return screw 50 decreases, is employed. In other words, in the embodiment, by reducing influence of the flow (arrow F3) of the developer which is peeled from the developing sleeve 43, the flow (arrow F4) of the developer in the space which is sandwiched between the partition 47 and the return screw 50 decreases.

[Flow of Two-component Developer in Embodiment]

Here, with reference to FIG. 5A, the flow of the two-component developer in the developing unit 4*a* will be described. FIG. 5A is a view illustrating the flow of the two-component developer in the developing unit 4*a* according to the embodiment.

The developing sleeve 43 holds and carries the two-component developer (developer), including the non-magnetic toner (toner) and the magnetic carrier (carrier), to the coating area 43*a* which functions as a developer carrying area. As illustrated in FIG. 5A, in the developing unit 4*a*, the coating area 43*a* for carrying the developer by the developing sleeve 43 is positioned downstream in the conveyance direction of the first conveyance screw 45 further than the opening 47*a*.

By setting a positional relation between the developing sleeve 43, the opening 47*a*, and the return screw 50 in this manner, the flow (arrow F3) of the developer which is peeled from the developing sleeve 43 has no relationship with the flow of the developer in the vicinity of the developer discharging portion. As a result, only the flow (arrow F1) from the second conveyance screw 46 to the first conveyance screw 45 and the flow (arrow F2) from the first conveyance screw 45 to the second conveyance screw 46, are combined. Accordingly, the flow (arrow F4) of the developer in the space which is sandwiched between the partition 47 and the return screw 50 can be reduced.

Here, a relationship between a positional relation of each of a coating end of the developing sleeve 43, the opening 47*a*, and the return screw 50, and a speed of the flow (arrow F4) of the developer in the space (measurement position X: FIG. 5A) which is sandwiched between the partition 47 and the return screw 50, will be described with reference to FIG. 6. In the embodiment, the flow of the developer in the measurement position X is photographed by a high-speed camera, and the speed in the direction of the discharging portion 53 is analyzed by particle image velocimetry (PIV).

Figure 6:
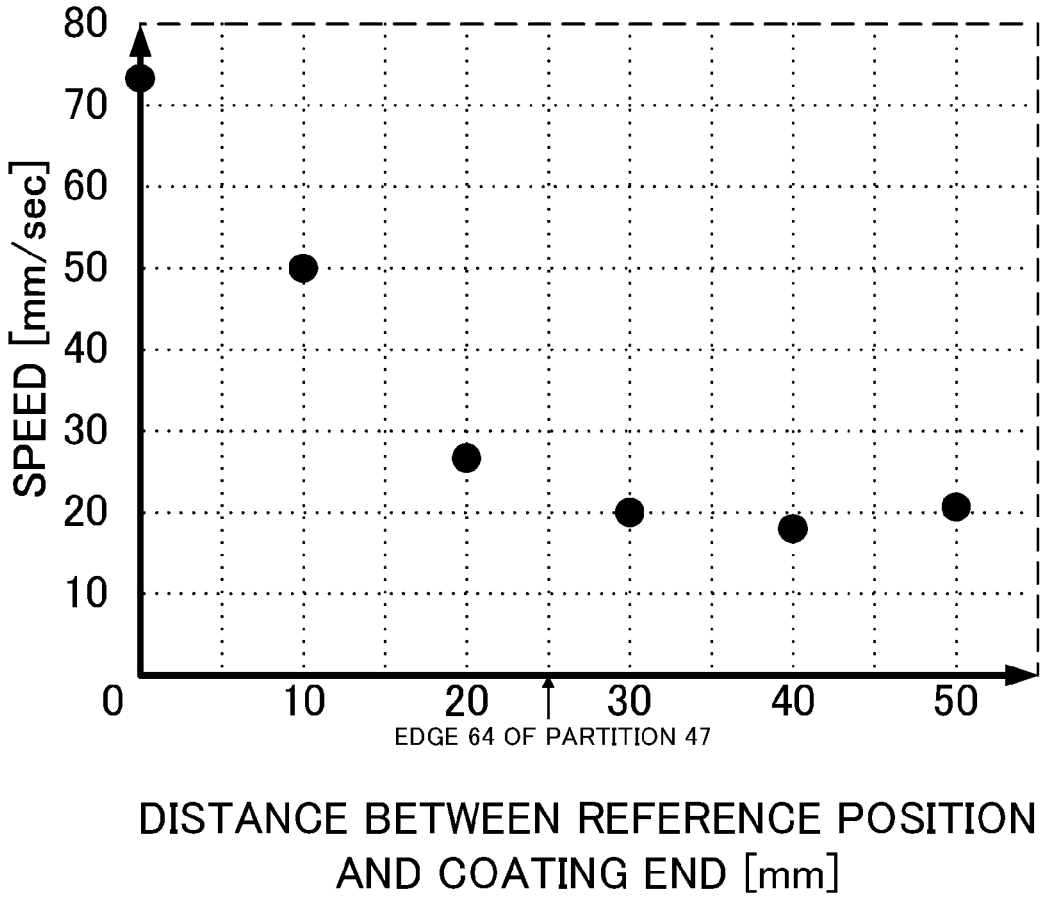
FIG. 6 is a graph illustrating a relationship between a position of the developing sleeve and a speed of the developer in the vicinity of a developer discharging portion.

In FIG. 6, an edge 63 (FIG. 5A) of the opening 47*a* on the return screw 50 side is considered as a reference (zero point), and a distance [mm] between the reference position and an end portion (coating end) of the coating area 43*a* of the developing sleeve 43 in a downstream direction of the first conveyance screw 45 is considered as a horizontal axis. A speed [mm/sec] in the direction of the discharging portion 53 at the measurement position X is considered as a vertical axis.

According to FIG. 6, as the coating end of the developing sleeve 43 moves apart from the measurement position (reference position) X, the speed in the direction of the discharging portion 53 at the measurement position X decreases. This is simply because the flow (arrow F4) of the developer in the space which is sandwiched between the partition 47 and the return screw 50 decreases as the influence of the flow (arrow F3) of the developer which is stripped from the developing sleeve 43 becomes smaller.

In addition, similarly to the configurations in Comparative Example 1 and Comparative Example 2, when the coating end of the developing sleeve 43 is in an area facing the opening 47*a*, by the flow (arrow F3) of the developer which is stripped from the developing sleeve 43, the flow of the developer in the vicinity of the opening 47*a* remains. Accordingly, this influences the flow (arrow F4) of the developer in the space which is sandwiched between the partition 47 and the return screw 50.

Similarly to the configuration of the embodiment, when the coating end of the developing sleeve 43 is present downstream in the developer conveyance direction (arrow B in FIG. 3) of the first conveyance screw 45 further than the opening 47*a*, then, the flow (arrow F3) of the developer which is stripped from the developing sleeve 43 does not influence the delivery of the developer of the opening 47*a*. Therefore, this also does not influence the flow (arrow F4) of the developer in the space which is sandwiched between the partition 47 and the return screw 50.

The speed does not become zero even when the developer climbs over an edge 64 on a side separated from the return screw 50, of the partition 47, because of the following reasons. In other words, this is because, since the flow (arrow F2) of the developer from the first conveyance screw 45 is present, the flow (arrow F2) collides with the flow (arrow F1) of the developer from the second conveyance screw 46, and the flow (arrow F4) of the developer in the space which is sandwiched between the partition 47 and the return screw 50 is substantially formed.

Figure 7:
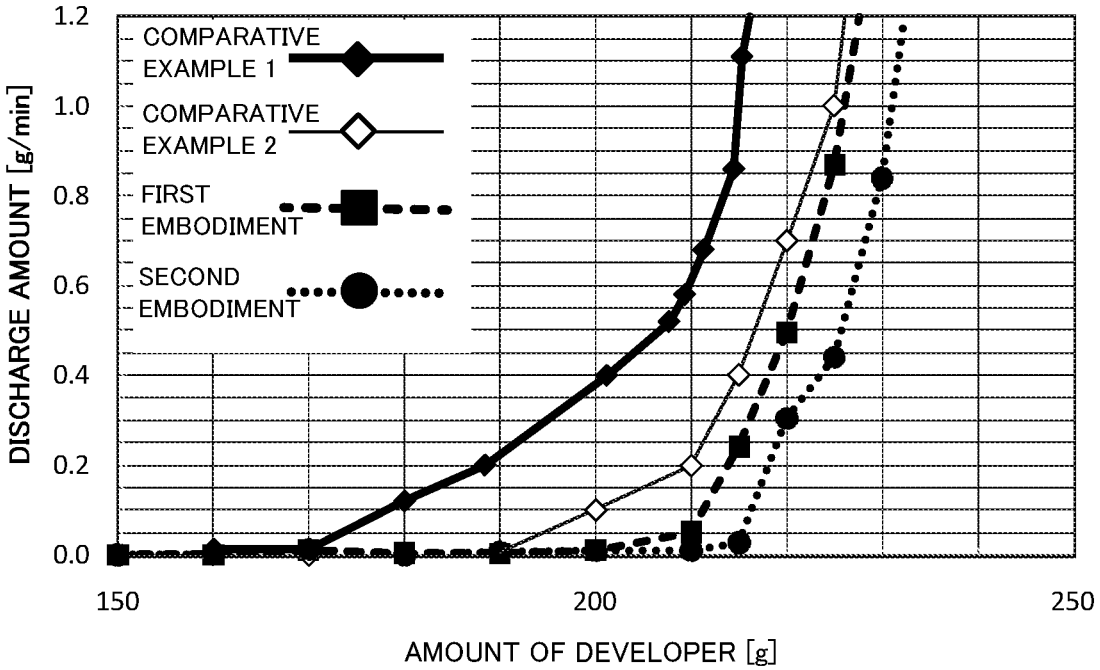
FIG. 7 is a graph illustrating discharging properties of the developer according to the first and the second embodiments, and Comparative Examples 1 and 2.

Here, the discharging properties of the developer in the developing unit 4*a* of the embodiment will be described with reference to FIG. 7. FIG. 7 is a graph illustrating the discharging properties of the developer in the developing unit 4*a*. In FIG. 7, a horizontal axis illustrates the amount of developer [g] which is stored in the developer container 42, and a vertical axis illustrates the discharge amount [g/min] of the developer per one minute when the developing unit 4*a* is continuously driven. In addition, all the conditions of Comparative Example 1, Comparative Example 2, and the first embodiment are the same as each other, except for the following content in Table 1 described below. In addition, a second embodiment in FIG. 7 will be described later.

TABLE 1

| | Distance between the reference position and the coating end | Length of the opening 47a | Presence or absence of the restriction member 52 |
|---|---|---|---|
| Comparative Example 1 | 0 [mm] | 25 [mm] | Absent |
| Comparative Example 2 | 0 [mm] | 25 [mm] | Present |
| First embodiment | 30 [mm] | 25 [mm] | Absent |

As illustrated in FIG. 7, when the amount of developer [g] is great, a height of a surface of the developer in the vicinity of the developer discharging portion (discharging portion 53) increases. For this reason, the return screw 50 does not completely return the developer, and the developer climbs over the return screw 50 and is discharged. Accordingly, the discharge amount [g/min] of the developer per one minute increases.

In the configuration of Comparative Example 1, since the influence of the flow (arrow F3) of the developer which is peeled from the developing sleeve 43 is strong, the flow (arrow F4) of the developer in the space which is sandwiched between the partition 47 and the return screw 50 becomes strong. For this reason, it is found that the developer is discharged little by little even when the amount of the developer is small. The amount of developer when the developer starts to be discharged is 170 [g].

In the configuration of Comparative Example 2, since the flow (arrow F4) of the developer in the space which is sandwiched between the partition 47 and the return screw 50 is blocked by the restriction member 52, the amount of the developer when the developer starts to be discharged is greater (190 [g]) than that of Comparative Example 1. However, the flow itself of the developer in the space which is sandwiched between the partition 47 and the return screw 50 is not suppressed.

In contrast, in the first embodiment, the influence of the flow (arrow F3) of the developer which is peeled from the developing sleeve 43 decreases, and the flow (arrow F4) of the developer in the space which is sandwiched between the partition 47 and the return screw 50 becomes weak. For this reason, compared to Comparative Examples 1 and 2, the amount of the developer when the developer starts to be discharged is great (200 [g]).

In addition, in the first embodiment, compared to Comparative Examples 1 and 2, the sensitivity of the amount of the developer [g] and the discharge amount of the developer [g/min] is high. This means that the decrease in the amount of the developer is suppressed and the amount of the developer in the developing unit is stabilized even when the amount of the replenishing carrier per unit image is small, compared to Comparative Examples 1 and 2.

As described above, in the developing unit 4*a* (4*b* to 4*d*) according to the embodiment, the coating area 43*a* which carries the developer by the developing sleeve 43 is positioned downstream in the conveyance direction of the first conveyance screw 45 further than the opening 47*a*. Accordingly, it is possible to reduce the flow of the developer in the space which is sandwiched between the partition 47 and the return screw 50. While maintaining the developer discharge amount when the amount of the developer is great, even when the amount of the developer is small, it is possible to suppress the amount of the two-component developer which climbs over the brim portion 51 and is discharged, and to reduce the amount of the discharged developer. Accordingly, even when the amount of the replenishing carrier per unit image is small, it is possible to suppress the decrease in the amount of the developer, to appropriately maintain the discharge amount of the two-component developer which passes through the discharging portion 53, and to stabilize the amount of the developer in the developing unit.

<Second Embodiment>

Figure 5B:
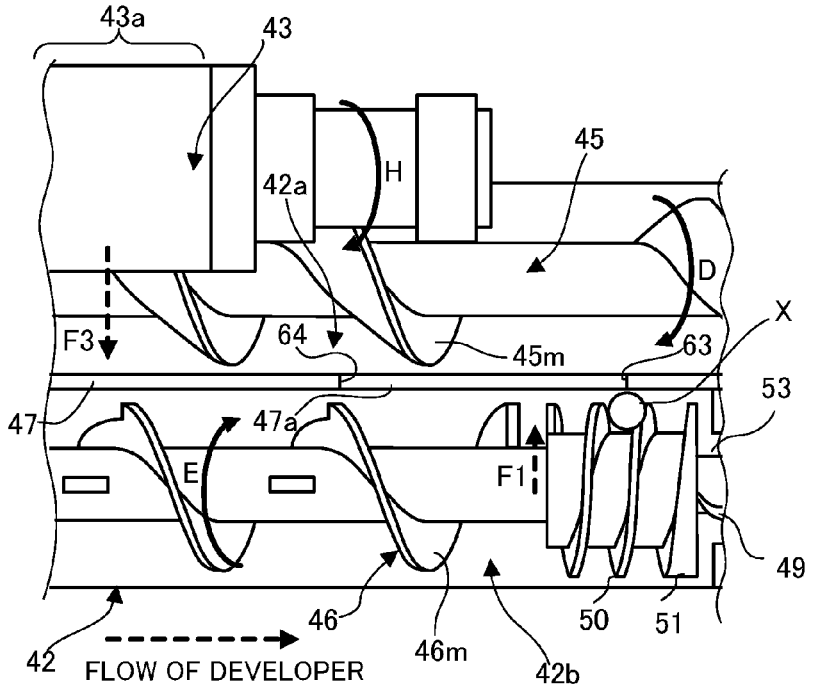
FIG. 5B is a view illustrating a flow of the developer in the vicinity of a developer discharging portion according to a second embodiment.

Next, the second embodiment according to this disclosure will be described with reference to FIG. 5B. FIG. 5B is a view illustrating the flow of the developer in the vicinity of the developer discharging portion (discharging portion 53) in the developing unit 4*a* of the embodiment. In addition, in the embodiment, the same members as those in the first embodiment are given the same reference numerals, and the description of the same configurations and functions will be omitted.

In the embodiment, in addition to the first embodiment, a configuration, in which the flow (arrow F2) of the developer from the first conveyance screw 45 in the vicinity of the developer discharging portion also substantially decreases, the flow (arrow F4) of the developer in the space which is sandwiched between the partition 47 and the return screw 50 further decreases, is employed.

In other words, in the embodiment, the first conveyance screw (first conveying member) 45 does not have a conveying blade 45*m* for conveying the developer at least at apart facing the return screw (third conveying member) 50, in an area facing the opening 47*a* as the first communication portion.

In other words, as illustrated in FIG. 5B, in addition to the configuration of the first embodiment, a configuration in which the conveying blade 45*m* of the first conveyance screw 45 is not provided at the position which opposes the return screw 50 that faces the opening 47*a*, is employed. In this manner, without providing the conveying blade 45*m* at the position which opposes the return screw 50 that faces the opening 47*a*, the flow (arrow F2) of the developer towards the cross-sectional direction of the first conveyance screw 45 decreases.

Therefore, the collision of the developer which is conveyed in the cross-sectional radial direction of the first conveyance screw 45 and the developer which is stripped and dropped from the developing sleeve 43 with the flow of the developer which passes through the opening 47*a* and is delivered to the first conveyance screw 45 from the second conveyance screw 46, is suppressed. Accordingly, the flow of the two-component developer, such as the arrow F4 (FIG. 5A) in the space which is sandwiched between the partition 47 and the return screw 50, decreases.

Here, the discharging properties of the developer of the developing unit 4*a* in the embodiment will be described with reference to the above-described FIG. 7. The embodiment further reduces the flow (arrow F4) of the developer in the space which is sandwiched between the partition 47 and the return screw 50 than the first embodiment. For this reason, compared to the first embodiment, the amount of the developer when the developer starts to be discharged is great, that is, 210 [g], and the sensitivity of the developer discharge amount with respect to the amount of the developer is high.

In the embodiment described above, in addition to the configuration of the first embodiment, it is possible to further reduce the flow of the developer in the space between the partition 47 and the return screw 50 as the conveying blade 45*m* of the first conveyance screw 45 is not provided at the position which opposes the return screw 50 that faces the opening 47*a*. Accordingly, while maintaining the developer discharge amount when the amount of the developer is great, even when the amount of the developer is small, it is possible to further suppress the amount of the two-component developer which climbs over the brim portion 51 and is discharged. Therefore, in the embodiment, compared to the first embodiment, even when the amount of the replenishing carrier per unit image is small, it is possible to suppress the decrease in the amount of the developer, to appropriately maintain the discharge amount of the two-component developer which passes through the discharging portion 53, and to stabilize the amount of the developer in the developing unit.

In addition, in the first and the second embodiments, a positional relation of each of the coating end of the developing sleeve 43 on the near side of the main body, the opening 47*a*, and the return screw 50 is defined. Meanwhile, as illustrated in FIG. 3, the coating end of the developing sleeve 43 on the far side of the main body is configured to be positioned within the range facing the opening 47*b* which delivers the developer to the second conveyance screw 46 from the first conveyance screw 45. In other words, the coating area 43*a* of the developing sleeve 43 extends from a position located downstream in the developer conveyance direction (arrow B direction) of the first conveyance screw 45 further than the opening 47*a* up to a position facing the opening 47*b*. Accordingly, in addition to appropriately maintaining the discharge amount of the two-component developer and stabilizing the amount of the developer in the developing unit, it is possible to downsize the developing unit in the longitudinal direction.

Furthermore, in a delivery area, the developer is likely to remain, and a height of the surface of the developer in the delivery area in the first conveyance screw 45 becomes higher compared to an area other than the delivery area. When the surface of the developer is extremely high, the developer which is stripped and dropped from the developing sleeve 43 that rotates in the same direction as that of the first conveyance screw 45, is drawn up to the developing sleeve 43 immediately without being stirred. As a result, as the developer having low toner density turns the developing sleeve 43 around, uneven image density or adherence of the carrier is likely to be generated. In the embodiment, as illustrated in FIG. 3, the first conveyance screw 45 includes a shaft member 450 which extends in parallel to a rotation shaft line of the developing sleeve 43, and the conveying blade 45*m* which rotates to be integrated with the shaft member 450 and conveys the developer. As the shaft member 450 is configured to include a first shaft portion 450*a*, and a second shaft portion 450*b* which is formed to have a smaller shaft diameter than that of the first shaft portion 450*a* at the position which opposes the opening 47*b*, the height of the surface of the developer in the delivery area in the first conveyance screw 45 is adjusted, and a stabilized surface of the developer and downsizing are achieved in the coating area (developer carrying area) 43*a*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-041674, filed on Mar. 4, 2014 which is hereby incorporated by reference herein in its entirety.

What is claimed is:

1. A developing unit comprising:

a developer carrier configured to bear a developer including a toner and a carrier on a developer carrying area;

a first chamber configured to face at least a part of the developer carrier and receive the developer falling from the developer carrier;

a second chamber provided next to the first chamber;

a partition configured to be disposed between the first chamber and the second chamber to separate the first chamber from the second chamber;

a first conveying member, disposed rotatably in the first chamber, configured to convey the developer in the first chamber in a first direction;

a second conveying member, disposed rotatably in the second chamber, comprising a spiral blade portion conveying the developer in the second chamber in a second direction opposite to the first direction, and a reverse spiral blade portion disposed downstream of the spiral blade portion in the second direction and configured to convey the developer in the first direction;

a discharging portion, provided in the second chamber and downstream of the reverse spiral blade portion in the second direction, configured to discharge the developer; and a plurality of communication portions communicating the first chamber and the second chamber with each other, and comprising a first communication portion, disposed downstream in the second direction, through which the developer is conveyed from the second chamber to the first chamber, and a second communication portion, disposed upstream in the second direction, through which the developer is conveyed from the first chamber to the second chamber among the plurality of communication portions, wherein a distance between an upstream end, in the second direction, of the first communication portion and a center, in a rotational axis direction of the developer carrier, of the developer carrier is greater than a distance between a downstream end, in the second direction, of the second communication portion and the center of the developer carrier.

2. The developing unit according to claim 1, wherein the first communication portion is provided more outward than the developer carrying area in the rotational axis direction of the developer carrier, and wherein the second communication portion is provided in a position overlapping an edge of the developer carrying area in the rotational axis direction of the developer carrier.

3. A developing unit comprising:

a developer carrier configured to bear a developer, including a toner and a carrier, on a developer carrying area;

a first chamber configured to face at least a part of the developer carrier and receive the developer from the developer carrier;

a second chamber provided next to the first chamber;

a partition configured to be disposed between the first chamber and the second chamber to separate the first chamber from the second chamber;

a first conveying member, disposed rotatably in the first chamber, configured to convey the developer in the first chamber in a first direction;

a second conveying member, disposed rotatably in the second chamber, comprising a spiral blade portion configured to convey the developer in the second chamber in a second direction opposite to the first direction, and a reverse spiral blade portion disposed downstream of the spiral blade portion in the second direction and configured to convey the developer in the first direction;

a discharging portion, provided in the second chamber and downstream of the reverse spiral blade portion in the second direction, configured to discharge the developer; and a plurality of communication portions, provided in the partition, configured to communicate the first chamber and the second chamber with each other, and comprising a first communication portion, disposed downstream in the second direction, through which the developer is conveyed from the second chamber to the first chamber, and a second communication portion, disposed upstream in the second direction, through which the developer is conveyed from the first chamber to the second chamber among the plurality of communication portions, wherein a distance between an upstream end, in the second direction, of the first communication portion and a center, in a rotational axis direction of the developer carrier, of the developer carrying area is greater than a distance between a downstream end, in the second direction, of the second communication portion and the center of the developer carrying area.

4. The developing unit according to claim 3, wherein the first communication portion is provided more outward than the developer carrying area in the rotational axis direction of the developer carrier, and wherein the second communication portion is provided in a position overlapping an edge of the developer carrying area in the rotational axis direction of the developer carrier.

* * * * *